US006390176B1

(12) United States Patent
Sucker et al.

(10) Patent No.: US 6,390,176 B1
(45) Date of Patent: May 21, 2002

(54) FUNNEL GEOMETRY OF A MOLD FOR THE CONTINUOUS CASTING OF METAL

(75) Inventors: Jürgen Sucker, Düsseldorf (DE); Romeo Capotosti, Narni (IT)

(73) Assignees: SMS Schloemann-Siemag Aktiengesellschaft, Düsseldorf (DE); Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/199,734

(22) Filed: Nov. 25, 1998

(30) Foreign Application Priority Data

Dec. 3, 1997 (DE) ..... 197 53 537

(51) Int. Cl.[7] ..... B22D 11/00
(52) U.S. Cl. ..... 164/418; 164/459
(58) Field of Search ..... 164/459, 418

(56) References Cited

U.S. PATENT DOCUMENTS 4,249,590 A * 2/1981 Willim ..... 164/418
5,651,411 A * 7/1997 Hirano et al. ..... 164/418
5,839,503 A * 11/1998 Pleschiutschnigg ..... 164/418

FOREIGN PATENT DOCUMENTS

| | | | | |
|---|---|---|---|---|
| JP | 2-207945 | * | 8/1990 | ..... 164/418 |
| JP | 61-7046 | * | 1/1996 | ..... 164/418 |
| WO | 9407628 | | 4/1994 | |
| WO | 94/07628 | * | 4/1994 | ..... 164/418 |

* cited by examiner

*Primary Examiner*—Nam Nguyen
*Assistant Examiner*—I.-H. Lin
(74) *Attorney, Agent, or Firm*—Friedrich Kueffner

(57) ABSTRACT

A funnel geometry of a mold for the continuous casting of metal, wherein the mold has a pouring portion with cooled long side walls and short side walls, wherein the pouring portion becomes narrower in the shape of a funnel in the casting direction until it reaches the size of the cast strand. In the funnel portion the inner contour of the long side walls is constructed convexly along a straight line connecting the upper edge of the mold and the outlet of the pouring portion.

8 Claims, 6 Drawing Sheets

FUNNEL GEOMETRY OF A MOLD FOR THE CONTINUOUS CASTING OF METAL

BACKGROUND OF THE INVENTION

1. Field of the Invention

The present invention relates to a funnel geometry of a mold for the continuous casting of metal. The mold has a pouring portion with cooled long side walls and short side walls, wherein the pouring portion becomes narrower in the shape of a funnel in the casting direction until it reaches the size of the cast strand.

2. Description of the Related Art

The dimensions of the pouring portion are essentially determined by the cross-section of the strand to be cast, the dimensions of the pouring pipe and the depth of immersion of the pouring pipe in the molten metal.

Because of the funnel-shaped configuration of the long side walls, the mold not only narrows in the casting direction, but also a change of the shape of the strand cross-section takes place. Consequently, in contrast to a conventional continuous casting mold with planar walls, additional deformations are imparted on the strand shell when it travels through a funnel-type mold. These deformations may lead to defects.

It is known in the art that, by selecting the configuration of the horizontal or vertical contours of the funnel-shaped pouring portion of a continuous casting mold, the deformations imparted to the strand can be distributed more favorably in order to counteract any generation of defects of the cast product.

In contrast to a conventional mold with planar or flat walls, in which the shrinkage of the strand is compensated by the inclination of the short side walls, in a continuous casting mold with a funnel-shaped pouring portion it is of great significance how the mold cross-section narrows in the casting direction.

If in one or more vertical sections of the mold the cross-section of the mold narrows to a greater extent than the shrinkage of the strand, additional deformations are imparted to the strand shell. Also, in that case, a uniform contact between the strand shell and the mold wall is no longer ensured. Areas with excessively high or low strand shell temperatures are created, which increases the probability of the generation of defects.

If the mold does not narrow enough, the strand shell will partially loose contact with the mold wall. The substantial reheating in these areas produces high thermal stresses which lead to defects.

The defects referred to are cracks, constrictions and disturbances of the structure. These defects become more serious the more the steel has the tendency to comparatively high shrinkage during the solidification and cooling of the strand shell being formed.

EP 0 268 910 B1 proposes to guide the strand shell which is still thin underneath the meniscus without deformation by providing long side walls which in the pouring portion extend essentially parallel to each other in a first section and are reduced to the thickness of the casting size in a subsequent section, wherein the first section extends to below the meniscus level to be adjusted during the casting operation into the area of the first strand shell formation. In this manner, the strand shell which is still thin underneath the meniscus is to be guided free of deformations.

EP 0 552 501 A2 discloses a mold for the continuous casting of steel strip in which the long side walls form a funnel-shaped pouring portion which is reduced toward the short side walls and in the casting direction to the size of the cast strip. The funnel-shaped pouring portion is determined by lateral circular arcs and middle circular arcs connected to the lateral circular arcs at the tangential points. For reducing the friction and wear and for reducing the tensile stress and bending stress of the strand shell, the radii of the lateral circular arcs are uniform in a section which extends at least 100 mm down from the upper edge of the mold.

DE 39 07 351 A1 discloses a proposal for forming the contour of the inner wall of the pouring funnel in the strand travel direction by three circular arcs which contact each other tangentially, wherein the radii of the circular arcs gradually increase in the strand travel direction and lead into the contour of the inner wall of the mold. In this manner, the deformation of the metal cast strand is distributed over a travel length which is as long as possible and constrictions and the formation of cracks in the strand shell of the metal cast strand are avoided. A distribution of the change of the shape of the strand shell which is as uniform as possible in a pouring portion shaped in this manner is achieved thereby that the radii of the circular arcs increase in the strand travel direction with equal or unequal factors.

SUMMARY OF THE INVENTION

Therefore, it is the primary object of the present invention to provide a further funnel geometry of a mold which improves the reduction of friction and wear between the strand shell and the mold walls. Particularly in the case of a strand shell formation of a steel which has the tendency to be subject to relatively high shrinkage, an even more pronounced reduction of the defects formed at the slab surface is to be realized by a narrowing of the mold cross-section which is adapted to the shrinkage behavior of the steel.

The present invention is based on the finding that, with a given horizontal contour of the funnel portion, the configuration or course of the narrowing of the mold cross-section in the casting direction can be predetermined by the shape of the vertical contour.

In accordance with the present invention, in the funnel portion the inner contour of the long side walls is constructed convexly along a straight line connecting the upper edge of the mold and the outlet of the pouring portion.

The convex inner contour may have a constant curvature or a changing curvature.

In accordance with a further development of the invention, the convex inner contour of the long side walls has a configuration which is circular arc-shaped, polygonal or trigonometrical.

In accordance with another development of the invention, the convex inner contour of the pouring portion extends to the outlet of the mold.

When the lower section of the mold has a portion with parallel walls, a particularly friction-free transition between the funnel portion and the subsequent portion with parallel walls is achieved thereby that the convex contour leads with a lower circular arc at the end into the straight portion having a steady configuration.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
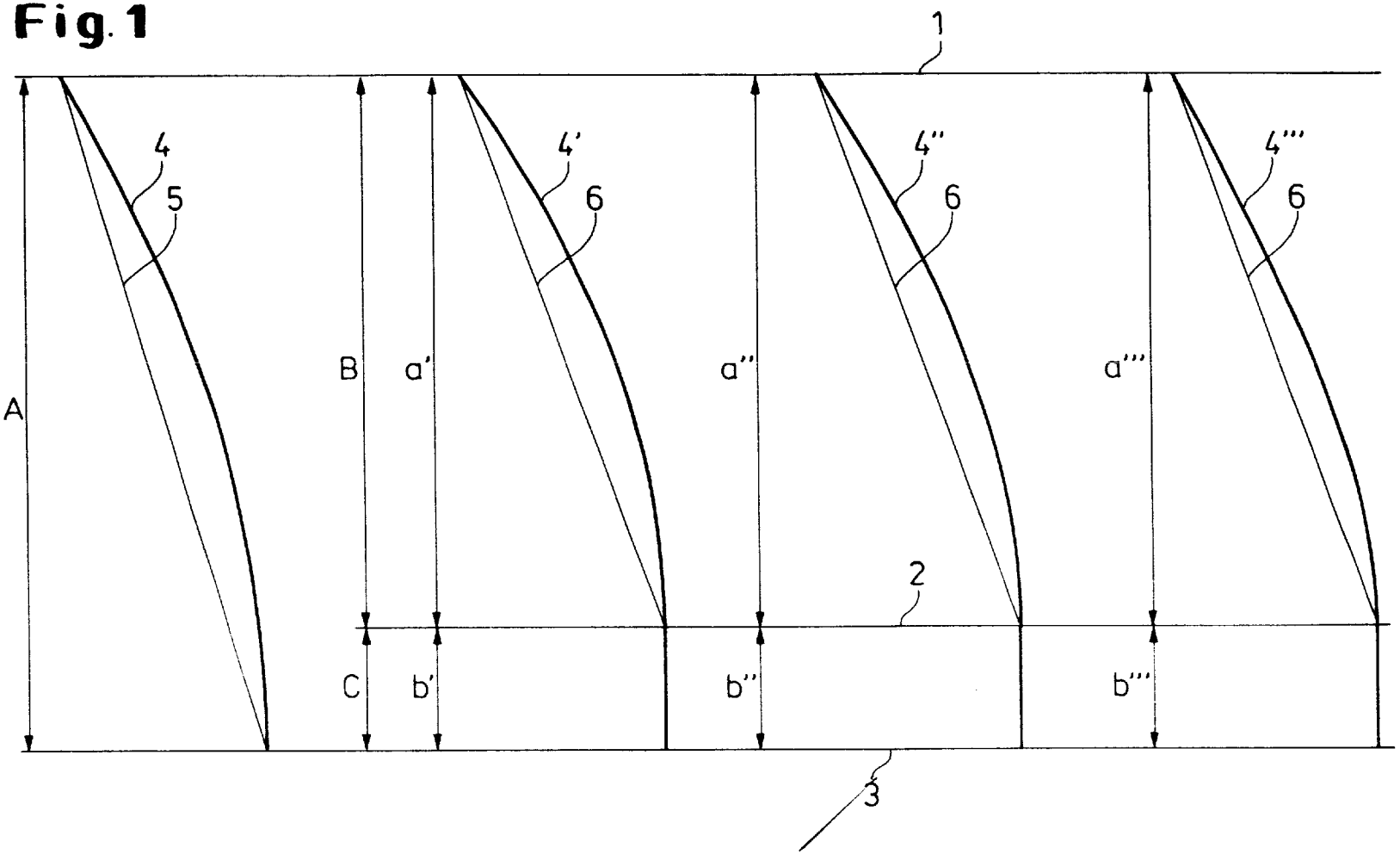
FIG. 1 is a sectional view along the middle axis of four different funnel-shaped inner contours of the long side walls of a mold according to the present invention.

The four different funnel contours of the long side wall of a mold shown in FIG. 1 have a pouring portion A which becomes narrower in the shape of a funnel in the casting direction until it reaches the size of the cast strand, or a pouring portion B which becomes narrower in the shape of a funnel in the casting direction until it reaches the size of the cast strand and a subsequent essentially parallel portion C. This mold portion or the mold outlet does not have to have parallel outlet surfaces or outlet edges. The lower mold portion or the lower mold outlet may have in the middle area thereof a small curvature of 1 to 15 mm for each long side wall.

In the funnel portion A, the funnel contours of the long side walls 4 are formed so as to be convex along a straight line connecting the upper edge 1 of the mold and the bottom edge 3 of the mold.

In the funnel portion B, the funnel contours of the long side walls 4' or 4" or 4'" are constructed so as to be convex along a straight line connecting the upper edge 1 and the beginning of the portion 2 with parallel side walls. It is apparent from the drawing that the inner contours of the long side walls have over the sections a', a" and a'" a circular arc-shaped, a sinusoidal and a polynomial configuration.

FIG. 1 also shows that the convex sections a', a" and a'" lead with a steady configuration into the respective sections b', b" and b'" having parallel walls.

In accordance with an important feature of the funnel geometry according to the present invention, each convex section A, a', a" and a'" may have a configuration with a constant curvature or with a changing curvature.

Figure 2:
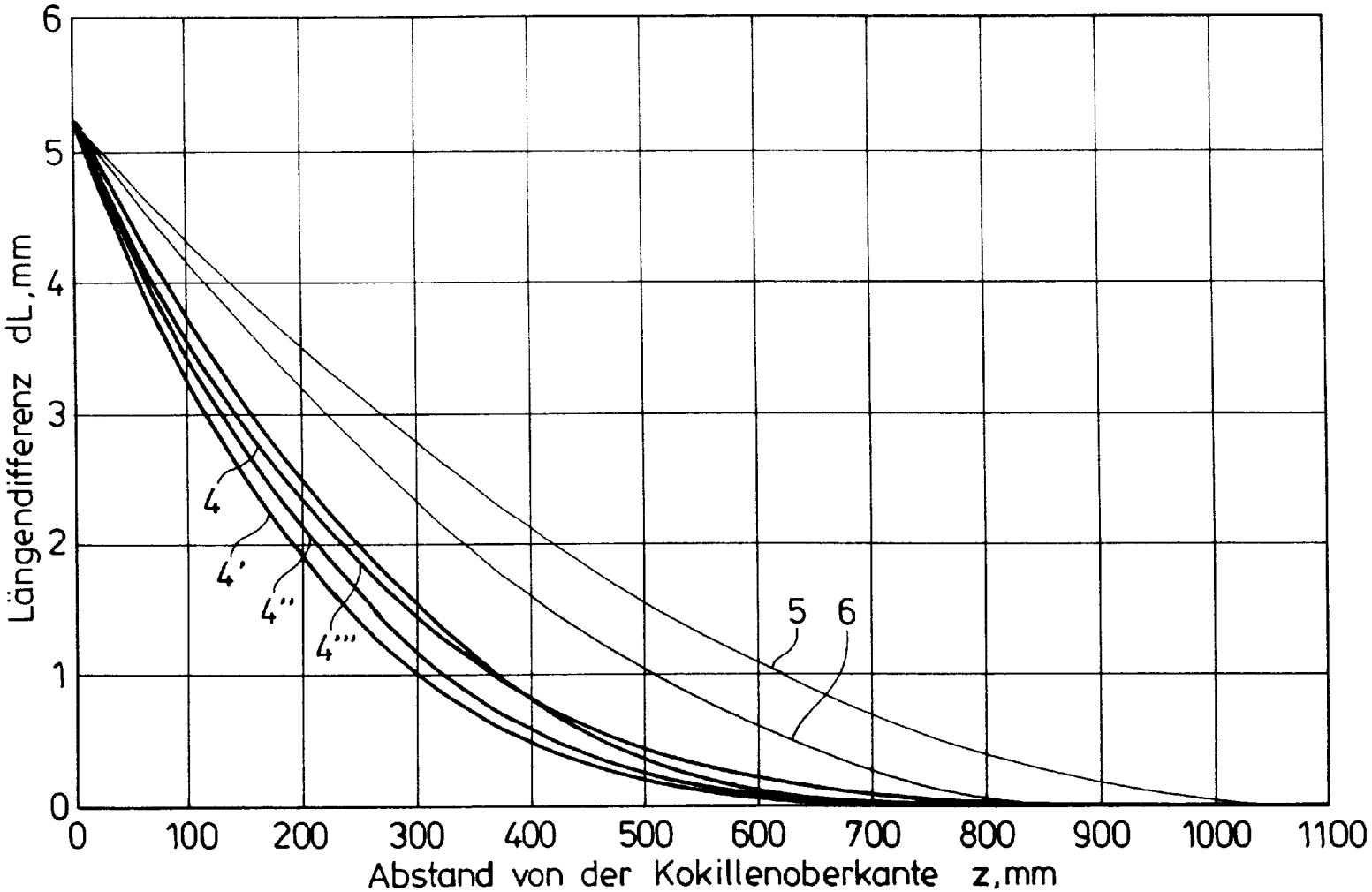
FIG. 2 is a diagram showing, plotted over the mold length, the length difference of the horizontal funnel contour and the corresponding horizontal parallel wall contour for the inner contours of the long side wall of a mold shown in FIG. 1 and for the two straight-line inner contours.

FIG. 2 of the drawing shows for the vertical inner contours illustrated in FIG. 1 the narrowing of the mold cross-section in the casting direction of a continuous casting mold having the following parameters:

Funnel width 950 mm;

Funnel depth at the upper edge of the mold plate 45 mm;

Funnel length 900 mm;

Sinusoidal horizontal contour.

Figure 3:
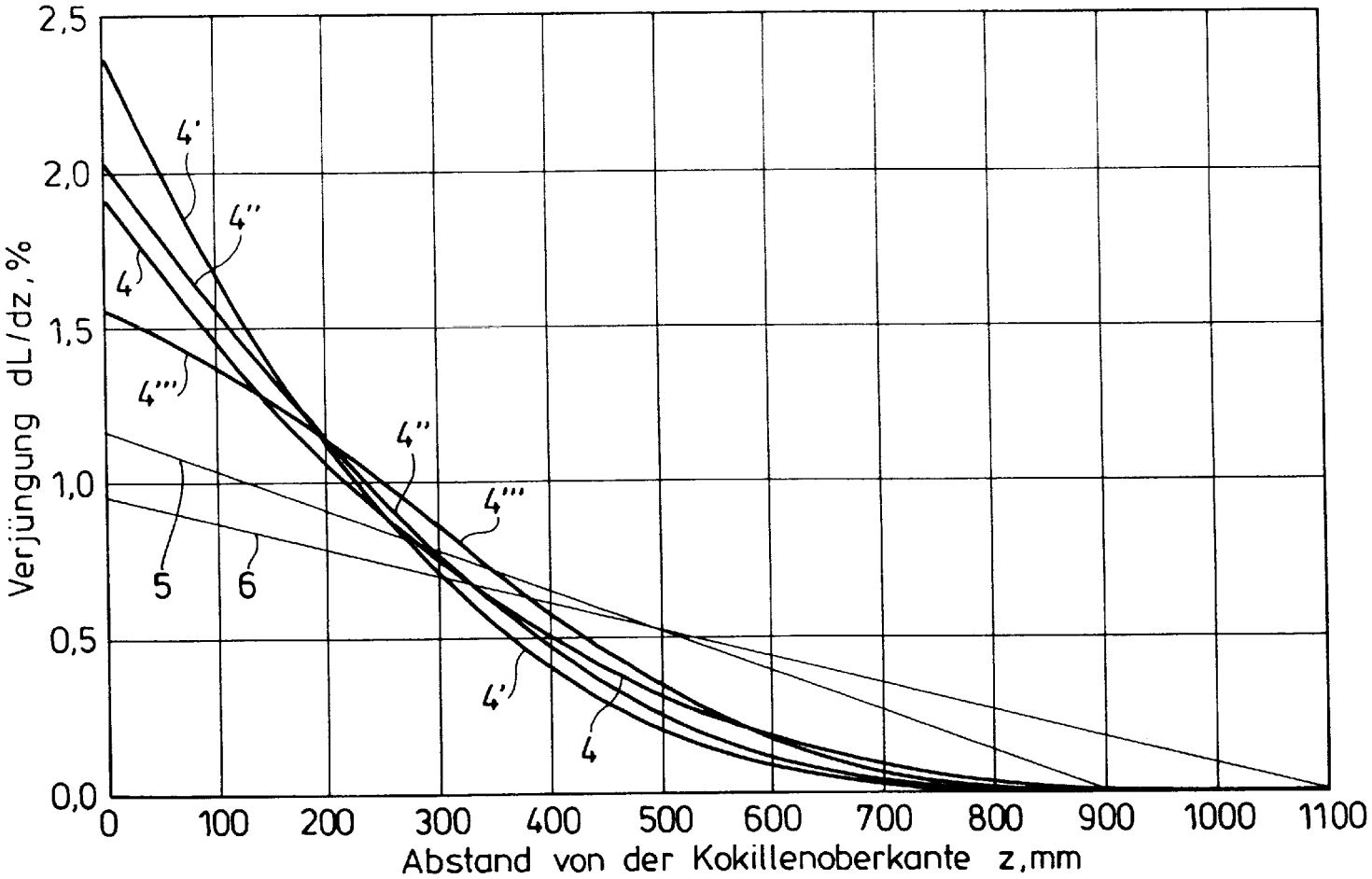
FIG. 3 is a diagram showing the narrowing of the mold cross-section in the casting direction for the inner contours of the long side wall of a mold according to the present invention shown in FIG. 1 and for the two straight-line inner contours.

FIGS. 2 and 3 show the effects of different convex vertical inner contours of the funnel portion and the length difference and narrowing of the mold cross-section.

FIGS. 1 to 3 point out the important feature according to the present invention which is the fact that, with unchanged parameters of the pouring portion, the introduction of a convex vertical inner contour of the pouring portion leads to a greater narrowing in the upper mold portion and to less narrowing in the lower mold portion.

For this reason, the present invention also provides for the use of the mold for continuously casting a strand of a peritectic carbon steels and austenitic stainless steels which have the tendency to be subject to extremely high shrinkage.

Figure 4:
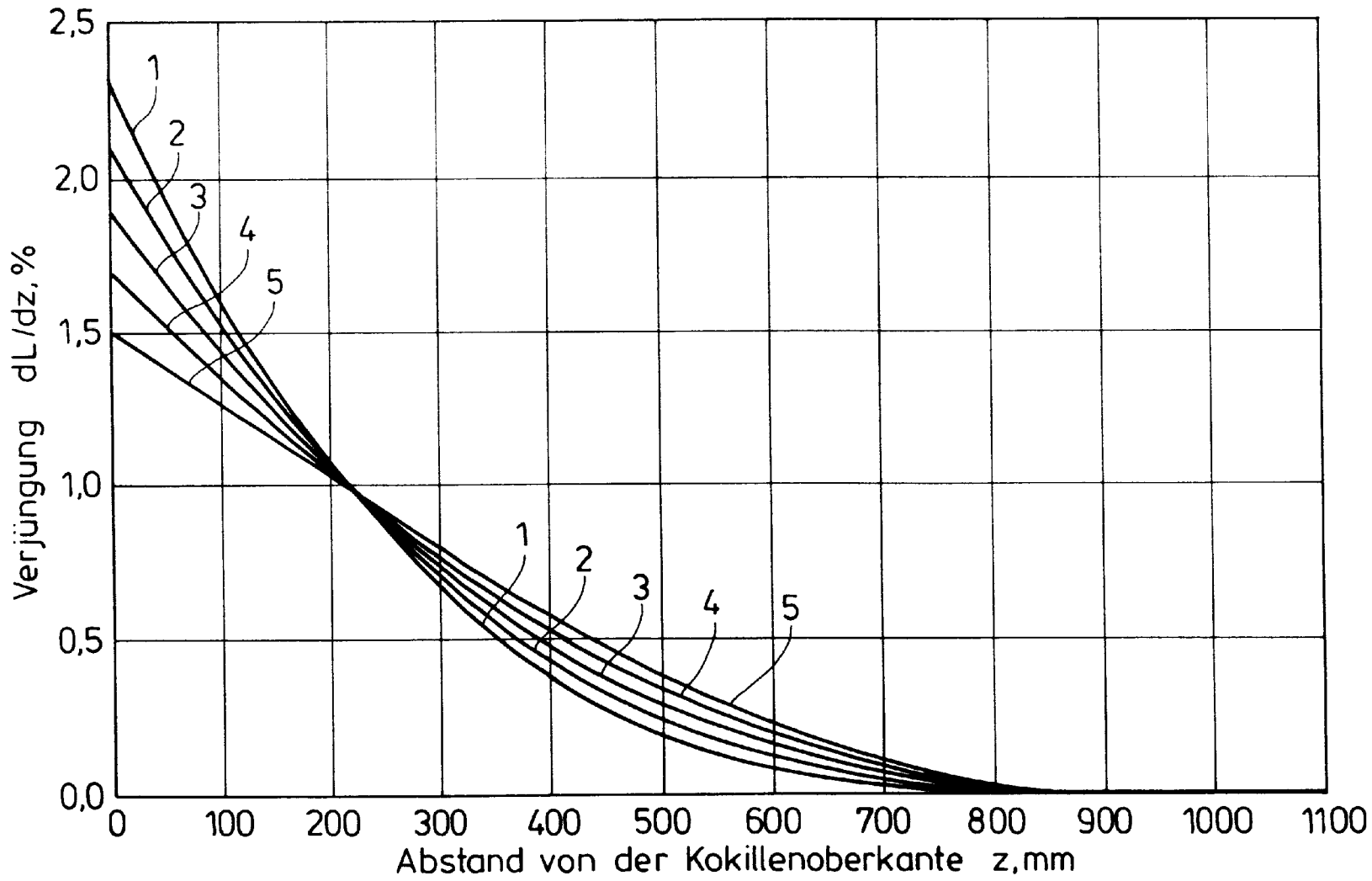
FIG. 4 is a diagram showing five different configurations of narrowing of the mold cross-section in the casting direction of a continuous casting mold with funnel-shaped pouring portion.
Figure 5:
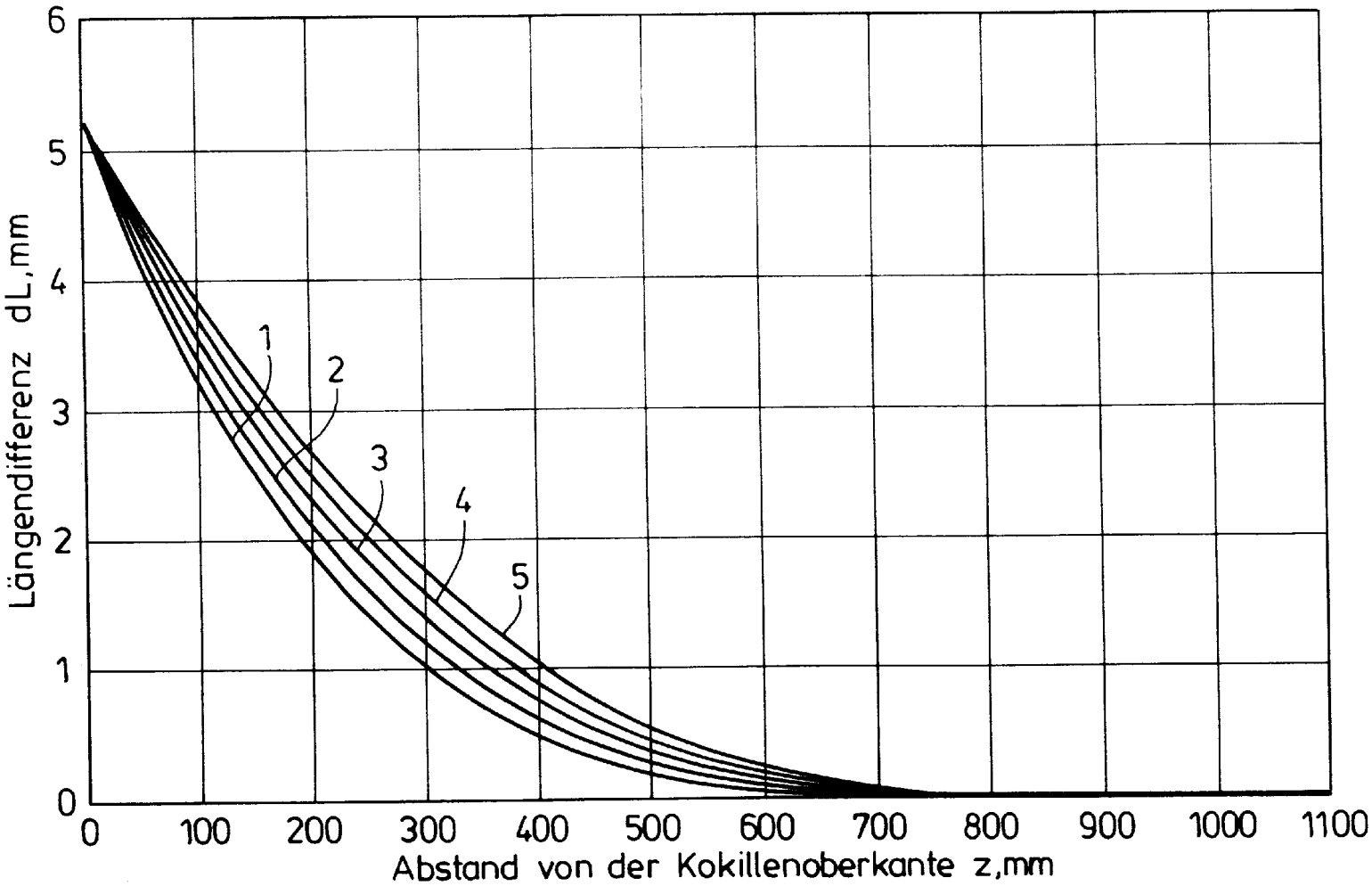
FIG. 5 is a diagram showing, plotted over the mold length, the length difference of the horizontal funnel contour and the corresponding horizontal parallel wall contour for the configurations shown in FIG. 4 of the narrowing of the mold cross-section in the casting direction of a continuous casting mold with funnel-shaped pouring portion.
Figure 6:
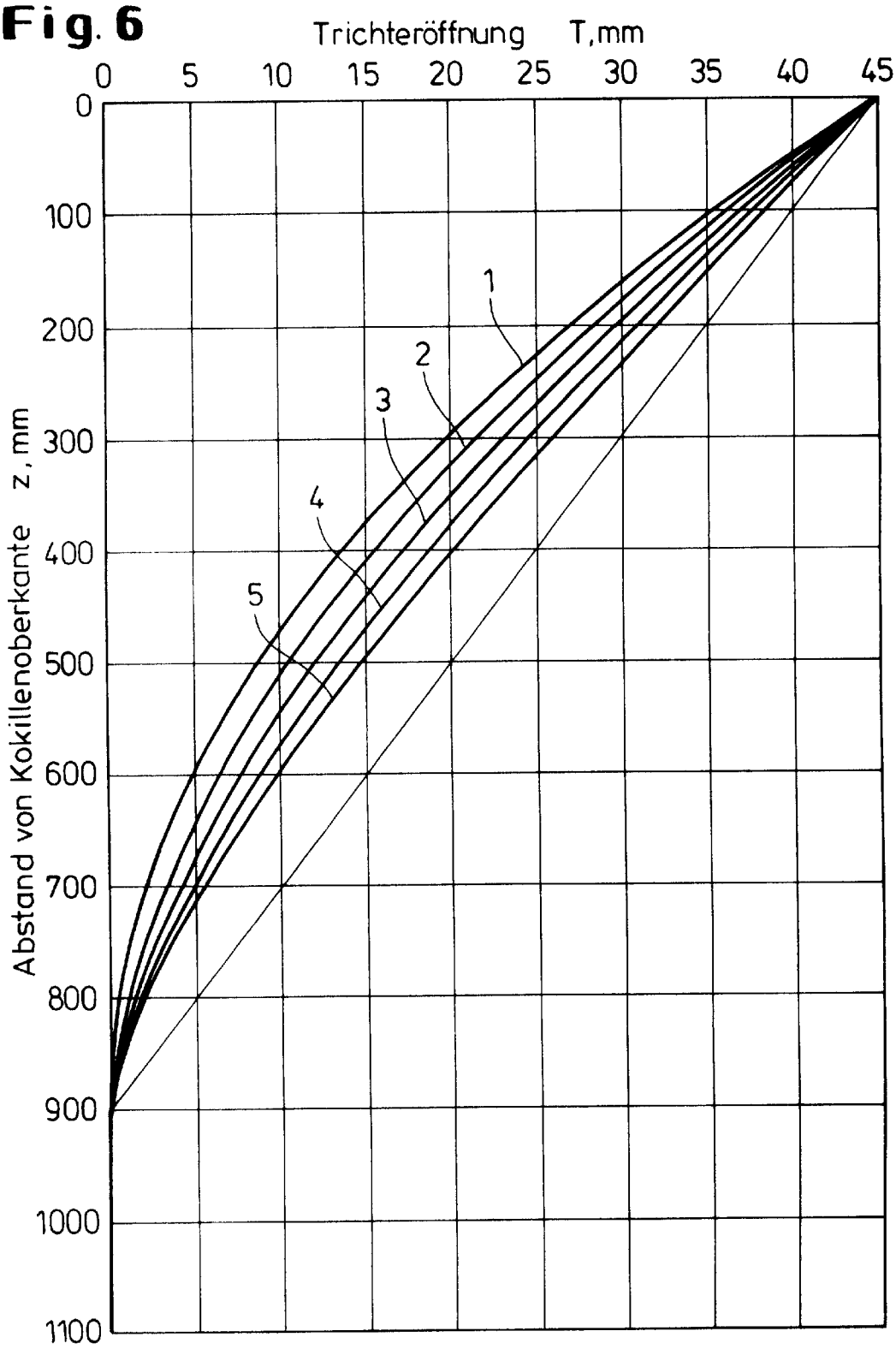
FIG. 6 is a sectional view along the middle axis of the convex funnel-shaped inner contours for the configurations shown in FIG. 4 of the narrowing speed of the mold cross-section in the casting direction of a continuous casting mold with funnel-shaped pouring portion.

FIG. 6 of the drawing shows an embodiment of the present invention with different vertical convex funnel contours for a continuous casting mold having the parameters already mentioned above. These funnel contours are based on the shrinkage configurations given in FIG. 4 and the corresponding length changes illustrated in FIG. 5. Each of the given shrinkage configurations corresponds to a certain combination of steel properties and casting parameters and can be determined by theoretical considerations and practical experience.

The relationships illustrated in FIGS. 1 through 6 demonstrate that, independently of the horizontal contour of the pouring portion of the mold, the narrowing of the mold cross-section in the casting direction can be variably adjusted within wide limits and, therefore, can be adapted to the shrinkage behavior of the strand which generally not only depends on the properties of the steel being poured, but also on other casting parameters, such as, the casting speed.

While specific embodiments of the invention have been shown and described in detail to illustrate the inventive principles, it will be understood that the invention may be embodied otherwise without departing from such principles.

We claim:

1. A mold for the continuous casting of metal comprising cooled long side walls and short side walls forming a pouring portion which narrows in the shape of a funnel in a casting direction toward a size of a cast strand, wherein the long side walls have inner contours, and wherein in the funnel-shaped pouring portion the inner contour of each long side wall has a convex shape along a straight line connecting an upper edge of the mold and an outlet of the funnel-shaped pouring portion.

2. The mold according to claim 1, wherein in the funnel-shaped pouring portion the inner contours of the long side walls have a convex shape along a straight line connecting the upper edge of the mold and a beginning of a lower vertical portion.

3. The mold according to claim 1, wherein in the funnel-shaped pouring portion the inner contours of the long side walls have a convex shape along a straight line connecting the upper edge of the mold and a lower edge of the mold.

4. The mold according to claim 1, wherein the inner contours of the long side walls have over one or more partial portions thereof a circular arc-shaped, a polynomial or a trigonometrical configuration.

5. The mold according to claim 1, wherein the inner contours of the long side walls have a constant curvature.

6. The mold according to claim 1, wherein the inner contours of the long side walls have a changing curvature.

7. The mold according to claim 1, wherein the convex inner contours of the long side walls have a circular arc-shape at a lower end thereof connected to a lower section having a steady configuration.

8. The mold according to claim 7, wherein the lower steady section has parallel walls.

* * * * *